US011398182B2

(12) United States Patent
Park et al.

(10) Patent No.: US 11,398,182 B2
(45) Date of Patent: Jul. 26, 2022

(54) DISPLAY DEVICE AND METHOD OF DRIVING THE SAME

(71) Applicant: Samsung Display Co., Ltd., Yongin-Si (KR)

(72) Inventors: Geon Hwi Park, Yongin-si (KR); Young Woon Choi, Yongin-si (KR); Ki Hyun Pyun, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/341,290

(22) Filed: Jun. 7, 2021

(65) Prior Publication Data

US 2022/0108650 A1 Apr. 7, 2022

(30) Foreign Application Priority Data

Oct. 5, 2020 (KR) ..... 10-2020-0128206

(51) Int. Cl.
*G09G 3/32* (2016.01)

(52) U.S. Cl.
CPC ..... *G09G 3/32* (2013.01); *G09G 2310/0278* (2013.01); *G09G 2310/08* (2013.01); *G09G 2320/041* (2013.01); *G09G 2360/16* (2013.01)

(58) Field of Classification Search
CPC ..... G09G 3/32; G09G 2310/0278; G09G 2310/08; G09G 2320/041; G09G 2360/16
See application file for complete search history.

(56) References Cited

U.S. PATENT DOCUMENTS

| | | | | |
|---|---|---|---|---|
| 9,269,301 | B2 | 2/2016 | Lee et al. | |
| 10,297,191 | B2 | 5/2019 | Hoffman | |
| 2012/0249619 | A1* | 10/2012 | Furukawa | G09G 3/3648 345/691 |
| 2014/0307007 | A1* | 10/2014 | Cho | G09G 3/3406 345/690 |
| 2016/0351097 | A1* | 12/2016 | Sato | G09G 3/344 |
| 2019/0228705 | A1* | 7/2019 | Furuya | H04N 9/3135 |

FOREIGN PATENT DOCUMENTS

| | | | |
|---|---|---|---|
| KR | 10-2017-0091517 | A | 8/2017 |
| KR | 10-2061554 | B1 | 1/2020 |

* cited by examiner

*Primary Examiner* — Andrew Sasinowski
(74) *Attorney, Agent, or Firm* — Innovation Counsel LLP

(57) ABSTRACT

A display device may include a pixel set, a timing controller, a data driver, and a scale factor provider. The pixel set that may include pixels. The pixels may be divided into pixel groups. The timing controller may calculate first load values corresponding to an image frame of input image data and may generate image data by scaling gradation values of the input image data using scale factors. The data driver may generate data signals corresponding to the image data and may supply the data signals to the pixel set. The scale factor provider may calculate the first load values and one or more second load values based on temperature data corresponding to a temperature of the pixel set and may generate the scale factors based on the one or more second load values and a common current value of a current received by the pixels.

20 Claims, 6 Drawing Sheets

DISPLAY DEVICE AND METHOD OF DRIVING THE SAME

CROSS-REFERENCE TO RELATED APPLICATION

This application claims priority to and the benefit of Korean Patent Application No. 10-2020-0128206 filed in the Korean Intellectual Property Office on Oct. 5, 2020; the Korean Patent Application is incorporated by reference.

BACKGROUND

(a) Field

The technical field relates to a display device and a method of driving the display device.

(b) Description of the Related Art

A display device typically includes pixels. Image frames to be displayed by the pixels may have different load values. For example, an image frame corresponding to a bright image may have a large load value, and an image frame corresponding to a dark image may have a small load value.

According to different load values, the amounts of current required by the pixels may be different. For displaying correct brightness, it is necessary to supply an appropriate amount of current to the pixels corresponding to the load value of the image frame. However, the luminous efficiencies of pixels may be different for different display areas due to process variations of the pixels, and the luminous efficiencies of the pixels may change according to a change in the ambient temperature.

If an incorrect amount of current is provided to the pixels, the quality of images displayed by the display device may be unsatisfactory.

SUMMARY

An object of the present invention is to provide a display device capable of supplying an appropriate current to pixels in response to a process variation of pixels and a change in ambient temperature.

An embodiment may be related to a display device. The display device may include a pixel set, a timing controller, a data driver, and a scale factor provider. The pixel set that may include pixels. The pixels may be divided into pixel groups. The timing controller may be electrically connected to the pixel set, may calculate first load values corresponding to an image frame of input image data, and may generate image data by scaling gradation values of the input image data using scale factors. The data driver that may be electrically connected to at least one of the pixel set and the timing controller, may generate data signals corresponding to the image data, and may supply the data signals to the pixel set. The scale factor provider may calculate the first load values and one or more second load values based on temperature data corresponding to a temperature of the pixel set and may generate the scale factors based on the one or more second load values and a common current value flowing through the pixels.

The scale factor provider may include a unit target current value generator that generates a unit target current value based on the common current value corresponding to a reference pixel group among the pixel groups.

The scale factor provider may include a scale factor generator that generates a target current value based on the unit target current value and the one or more second load values, and generates the scale factors based on the target current value and the common current value.

The timing controller may calculate a first load value corresponding to each of the pixel groups.

The scale factor provider may include a temperature calculator that calculates predicted temperature data sets for the pixel groups based on the temperature data and the first load values.

The scale factor provider may include a load weight calculator that calculates load weights based on the predicted temperature data sets, first weight data sets, and second weight data sets.

Each of the first weight data sets may correspond to light emission efficiency values of a corresponding one of the pixel groups. Each of the second weight data sets may correspond to light emission efficiency of the pixels in an associated one of the pixel groups according to the temperature of the pixel set.

The load weight calculator may calculate a load weight by multiplying a value from a corresponding second weight data set and a value from a corresponding first weight data set. The value from the corresponding second weight data set may be according to the temperature of the pixel set based on a corresponding predicted temperature data set.

The pixel groups may include a first pixel group and a second pixel group. Light emission efficiency for the first pixel group may be higher than light emission efficiency for the second pixel group. A value of the first weight data set for the first pixel group may be smaller than a value of the first weight data set for the second pixel group.

A first temperature of the pixel set may be lower than a second temperature of the pixel set. A value of the second weight data set for the first temperature of the pixel set may be larger than a value of the second weight data set for the second temperature of the pixel set.

The pixels may include a first pixel including a first light emitting diode, a second pixel including a second light emitting diode, and a third pixel including a third light emitting diode. The load weight calculator may calculate a second weight data set for the first light emitting diode, a second weight data set for the second light emitting diode, and a second weight data set for the third light emitting diode. The second weight data set for the first light emitting diode, the second weight data set for the second light emitting diode, and the second weight data set for the third light emitting diode may be unequal according to the temperature of the pixel set.

The load weight calculator may calculate the load weights respectively corresponding to the pixel groups.

The scale factor provider may include a load determiner that calculates the one or more second load values based on the first load values and the load weights respectively corresponding to the pixel groups.

The load determiner may calculate the one or more second load values by multiplying a corresponding first load value and a corresponding load weight for each of the pixel groups to produce multiplied values and by adding the multiplied values.

The pixels include a current sensor that is connected to a first power source line and generates the common current value by sensing a current transmitted through the first power source line.

The display device may include a temperature sensor that generates the temperature data by sensing the temperature of the pixel set.

An embodiment may be related to a method of operating a display device. The display device may include a pixel set that includes pixels. The pixels may be divided into pixel groups. The method may include the following steps: calculating one or more first load values corresponding to an image frame of input image data; calculating one or more second load values based on the one or more first load values and temperature data corresponding to a temperature of the pixel set; generating one or more scale factors based on the one or more second load values and a common current value flowing through the pixels; generating image data by scaling gradation values of the input image data using the one or more scale factors; generating data signals corresponding to the image data; and supplying the data signals to the pixels for the pixels to emit light according to the data signals.

The generating of the scale factor may include the following steps: generating a unit target current value based on the common current value corresponding to a reference pixel group among the pixel groups; generating a target current value based on the unit target current value and the one or more second load values; and generating the one or more scale factors based on the target current value and the common current value.

The calculating of the one or more second load values may include the following steps: calculating predicted temperature data sets for the pixel groups based on the temperature data and the one or more first load values; calculating load weights based on the predicted temperature data sets, first weight data sets, and second weight data sets; and calculating the one or more second load values based on the one or more first load value and the load weights.

Each of the first weight data sets may correspond to light emission efficiency values of a corresponding one of the pixel groups. Each of the second weight data sets may correspond to light emission efficiency of the pixels in an associated one of the pixel groups according to the temperature of the pixel set.

According to embodiments, a display device may perform a global current control operation in consideration of light emission efficiency of pixels for pixel groups and the light emission efficiency of the pixels according to ambient temperature. Accordingly, an appropriate current may be supplied to the pixels. Advantageously, satisfactory image display quality may be attained.

BRIEF DESCRIPTION OF THE DRAWINGS

Each of FIG. 7A, FIG. 7B.

DETAILED DESCRIPTION OF EMBODIMENTS

Figure 1:
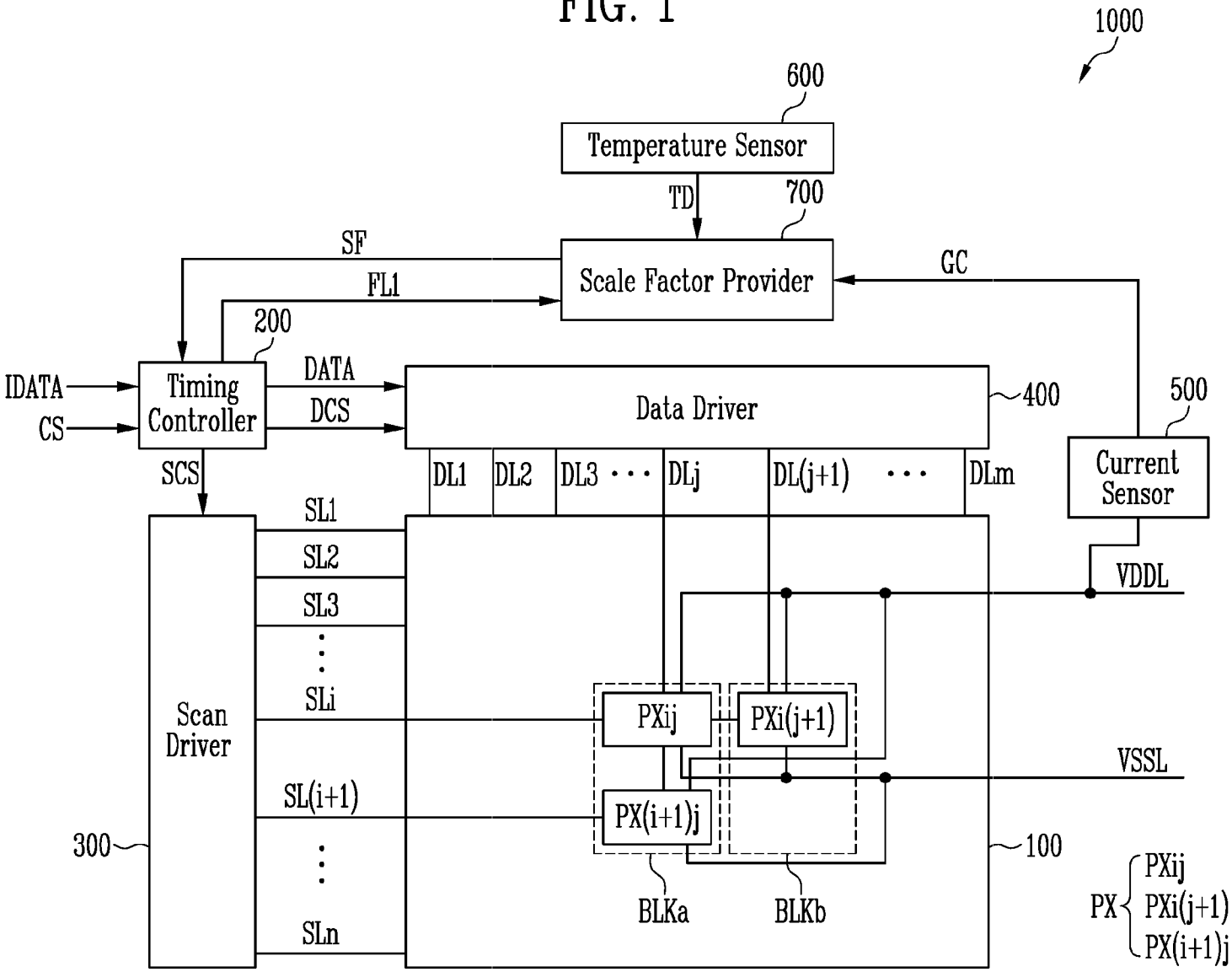
FIG. 1 is a block diagram illustrating a display device according to embodiments.

Example embodiments are described with reference to the drawings. Various modifications may be made in the described embodiments.

In the drawings, similar reference numerals may be used for similar elements, and dimensions may be enlarged for clarity.

Terms such as first and second may be used to describe different elements, but the elements should not be limited by the terms. These terms are used for distinguishing one element from another element. For example, a first component may be referred to as a second component, and/or a second component may be referred to as a first component. The description of an element as a "first" element may not require or imply the presence of a second element or other elements. The terms "first," "second," etc. may be used to differentiate different categories or sets of elements. For conciseness, the terms "first," "second," etc. may represent "first-category (or first-set)," "second-category (or second-set)," etc., respectively.

Singular expressions may mean plural expressions unless the context clearly indicates otherwise.

The term "connected" may mean "electrically connected" or "electrically connected through no intervening transistor." The term "insulate" may mean "electrically insulate" or "electrically isolate." The term "conductive" may mean "electrically conductive." The term "drive" may mean "operate" or "control." The expression "an image frame" may mean data for the image frame."

FIG. 1 is a block diagram illustrating a display device according to embodiments.

Referring to FIG. 1, a display device 1000 may include a display panel 100, a timing controller 200, a scan driver 300, a data driver 400, a current sensor 500, a temperature sensor 600, and a scale factor provider 700.

The display panel 100 (pixel set) may include pixels PX. Each of the pixels PX may be connected to a corresponding data line and a corresponding scan line. A pixel PXij (where i and j are natural numbers) may mean a pixel in which a scan transistor is connected to the $i^{th}$ scan line SLi and the $j^{th}$ data line DLj, a pixel PXi(j+1) may mean a pixel in which a scan transistor is connected to the $i^{th}$ scan line SLi and the $j+1^{th}$ data line DL(j+1), and a pixel PX(i+1)j may mean a pixel in which a scan transistor is connected to the $i+1^{th}$ scan line SL(i+1) and the $j^{th}$ data line DLj.

The pixels PX may be connected to a first power source line VDDL and a second power source line VSSL. The pixels PX may receive a voltage of the first power source through the first power source line VDDL, and a voltage of the second power source through the second power source line VSSL. The voltage of the first power source and the voltage of the second power source may drive the pixels PX, and the voltage level of the first power source may be higher than the voltage level of the second power source. For example, the voltage of the first power source may be a positive voltage, and the voltage of the second power source may be a negative voltage.

The pixels PX may be commonly connected to the first power source line VDDL. The pixels PX may be commonly connected to the second power source line VSSL. The pixels PX may be connected to different second power source lines. The pixels PX may be connected to different first power source lines.

The display panel 100 is divided into pixel groups, including pixel groups BLKa and BLKb. Each of the pixel groups BLKa and BLKb may include at least one pixel. For example, the first pixel group BLKa may include the pixels PXij and PX(i+1)j, and the second pixel group BLKb may include a pixel PXi(j+1).

The timing controller 200 may receive input image data IDATA and a control signal CS from an external source. The control signal CS may include a synchronization signal, a clock signal, and the like. The input image data IDATA may include (data for) at least one image frame.

The timing controller 200 may generate a first control signal SCS (scan control signal) and a second control signal DCS (data control signal) based on the control signal CS. The timing controller 200 may supply the first control signal SCS to the scan driver 300 and may supply the second control signal DCS to the data driver 400.

The first control signal SCS may include a scan start signal, a clock signal, and the like. The scan start signal may control the timing of the scan signal. The clock signal included in the first control signal SCS may be used to shift the scan start signal.

The second control signal DCS may include a source start signal, a clock signal, and the like. The source start signal may control a sampling start point of data. The clock signal included in the second control signal DCS may control a sampling operation.

The timing controller 200 may calculate a frame load value FL1 (first load value) corresponding to each image frame of the input image data IDATA. The frame load value FL1 may correspond to gradation values of the image frame. For example, as the sum of the gradation values of the image frame increases, the frame load value FL1 of a corresponding image frame may increase.

For example, the frame load value FL1 may be 100 in a full-white image frame, and the frame load value FL1 may be 0 in a full-black image frame. The full-white image frame may mean an emission image frame with maximum luminance in which all pixels PX of the display panel 100 are set to maximum gradations (white gradations) to emit light. The full-black image frame may mean a non-emission image frame in which all pixels PX of the display panel 100 are set to the lowest gradations (black gradations). The frame load value FL1 may be in a range of 0 to 100.

The timing controller 200 may calculate the frame load value FL1 for each of the pixel groups of the display panel 100. The frame load value FL1 may include frame load values corresponding to each of the pixel groups BLKa and BLKb.

The timing controller 200 may provide the calculated frame load value FL1 to the scale factor provider 700, and may scale the gradation values of the input image data IDATA using a scale factor SF received from the scale factor provider 700. The scale factor SF may be applied commonly to all pixels PX of the display panel 100. The gradation values of the input image data IDATA may be scaled at the same rate based on the scale factor SF.

The timing controller 200 may generate the image data DATA by rearranging the input image data IDATA obtained by scaling the gradation values, and may provide the generated image data to the data driver 400.

The scan driver 300 may receive the first control signal SCS from the timing controller 200, and may provide the scan signals to the scan lines SL1, SL2, SL3 to SLn (where n is natural number) based on the first control signal SCS. For example, the scan driver 300 may sequentially provide the scan signals to the scan lines SL1 to SLn. If the scan signals are sequentially provided, the pixels PX are selected in units of horizontal lines (or in units of pixel rows), and the data signal may be supplied to the selected pixels PX. A scan signal may be set to a gate-on voltage (low voltage or high voltage) such that a transistor included in each of the pixels PX and receiving the scan signal is turned on.

The data driver 400 may receive the image data DATA and the second control signal DCS from the timing controller 200, and may supply the data signals (data voltages) corresponding to the image data DATA to the data lines DL1, DL2, DL3 to DLm (where m is natural number) in response to the second control signal DCS. The data signals supplied to the data lines DL1 to DLm may be supplied to the pixels PX selected by the scan lines. The data driver 400 may supply the data signals to the data lines DL1 to DLm in synchronization with the scan signal.

Since the image data DATA is generated based on the input image data IDATA obtained by scaling the gradation values with the scale factor SF, the data driver 400 may supply the data signals corresponding to the scaled gradation values to the data lines DL1 to DLm. For example, the data driver 400 may apply a data signal corresponding to the scaled gradation value of the pixel PXij to the $j^{th}$ data line DLj, and may apply a data signal corresponding to the scaled gradation value of the pixel PXi(j+1) to the $j+1^{th}$ data line DL(j+1).

The current sensor 500 may be connected to the first power source line VDDL connected commonly to the pixels PX. The current sensor 500 may supply a global current value GC (common current value) to the scale factor provider 700 by sensing a current through the first power source line VDDL. The global current value GC may correspond to a current supplied commonly to all pixels PX through the first power source line VDDL. The current sensor 500 may sense a current through the second power source line VSSL via a connection to the second power source line VSSL connected commonly to the pixels PX.

The display device 1000 emits light of a pixel group that is set as a reference pixel group among the pixel groups. The current sensor 500 may sense a current through the first power source line VDDL, generate the global current value GC, and supply the generated global current value GC to the scale factor provider 700. The scale factor provider 700 may store a unit target current value corresponding to the global current value GC on a memory.

A storage operation of the unit target current value may be performed once when the display device 1000 is turned on. The timing and the number of times of storing the unit target current value may be set according to embodiments.

The scale factor provider 700 may generate a target current value based on the unit target current value and the frame load value FL1, and may generate the scale factor SF by comparing the global current value GC provided from the current sensor 500 and the target current value. For example, the scale factor provider 700 may determine a ratio between the target current value and the global current value GC as the scale factor SF. For example, the scale factor provider 700 may determine the scale factor SF such that if the global current value GC is greater than the target current value, the gradation values of the pixels PX are scaled smaller. As another example, the scale factor providing unit 700 may determine the scale factor SF such that if the global current value GC is smaller than the target current value, the gradation values of the pixels PX are scaled larger. The above-described driving process may be referred to as global current management GCM.

The light emission efficiency levels of the pixels PX may be different due to process variations of the pixels PX. For example, the light emission efficiency levels of light emitting diodes (for example, light emitting diode emitting red light, light emitting diode emitting green light, light emitting diode emitting blue light, and the like) included in the pixels PX may be different. The light emission efficiency levels of the pixels PX may be different according to ambient temperature of the display device 1000. For example, the light emitting diodes included in the pixels PX may have different light emission efficiency levels according to the ambient temperature. The light emission efficiency level of a pixel PX may mean the light emission luminance of the pixel PX in relation to a current supplied to the pixel PX. When the display device 1000 (scale factor provider 700) performs a global current control operation regardless of the different light emission efficiency levels of the pixels PX, the current supplied to the pixels PX may not be optimal, such that the pixels PX may emit light with a luminance different from the target luminance.

In order to compensate for variations in the light emission efficiency levels of the pixels PX, the display device 1000 (and/or scale factor provider 700) may determine the scale factor SF in consideration of the variations of the light emission efficiency levels of the pixels PX.

The temperature sensor 600 may generate temperature data TD by sensing the ambient temperature of the display device 1000 (and/or display panel 100). The temperature sensor 600 may provide the temperature data TD to the scale factor provider 700.

The scale factor provider 700 may calculate a correction load value (second load value) using the temperature data TD from the temperature sensor 600 and may apply a weight to the frame load value FL1 based on the light emission efficiency level for each of the pixel groups stored on the memory and the light emission efficiency levels of the pixels PX according to temperature.

The scale factor provider 700 may generate the target current value based on the correction load value and the unit target current value. For example, the scale factor provider 700 may generate the target current value by multiplying the correction load value and the unit target current value. The scale factor provider 700 may generate the scale factor SF based on the global current value GC and the target current value provided from the current sensor 500.

The display device 1000 (and/or scale factor provider 700) may perform the global current control operation in consideration of the light emission efficiency level of each pixel group and the light emission efficiency levels of the pixels PX according to the ambient temperature. Advantageously, an appropriate current may be supplied to the pixels PX in consideration of the process variations of the pixels PX and a change in ambient temperature.

The scale factor provider 700 may be implemented in a separate integrated chip (IC) different from the timing controller 200. All or part of the scale factor provider 700 may be integrated with the timing controller 200 in the same IC. All or part of the scale factor provider 700 may be implemented in software in the timing controller 200.

Figure 2:
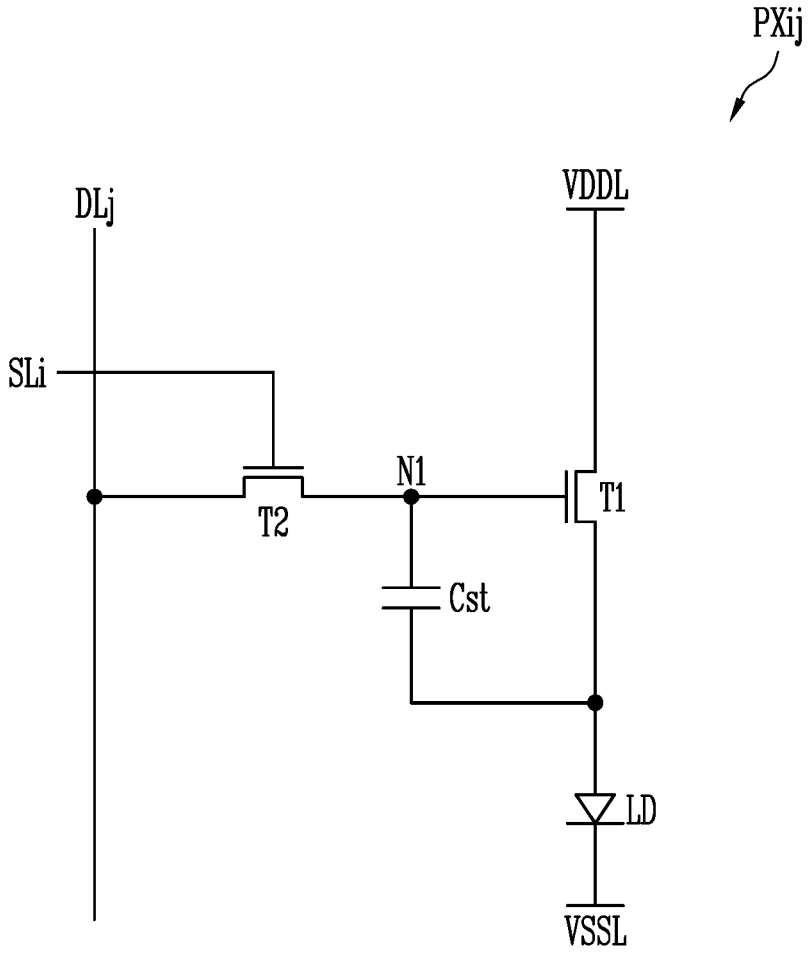
FIG. 2 is a circuit diagram illustrating a pixel included in the display device of FIG. 1 according to embodiments.

FIG. 2 is a circuit diagram illustrating a pixel included in the display device of FIG. 1 according to embodiments.

Referring to FIG. 2, the pixel PXij includes transistors T1 and T2, a storage capacitor Cst, and a light emitting diode LD.

The circuit may include N-type transistors. The circuit may include P-type transistors. The circuit may include at least one P-type transistor and at least one N-type transistor. For a P-type transistor, the amount of current conducted may increase when a voltage difference between the gate electrode and a source electrode increases in a negative direction. For an N-type transistor, the amount of current conducted may increase when the voltage difference between the gate electrode and the source electrode increases in the positive direction. A transistor may be a thin film transistor (TFT), a field effect transistor (FET), or a bipolar junction transistor (BJT).

A first transistor T1 may be connected between the first power source line VDDL and the light emitting diode LD, and the gate electrode may be connected to a first node N1. The first transistor T1 may control an amount of current flowing from the first power source line VDDL to the second power source line VSSL via the light emitting diode LD in response to the voltage of the first node N1. The first transistor T1 may be referred to as a driving transistor.

The second transistor T2 may be connected between the data line DLj and the first node N1, and the gate electrode may be connected to the scan line SLi. When the scan signal is supplied to the scan line SLi, the second transistor T2 is turned on such that the data line DLj and the first node N1 may be electrically connected to each other. Accordingly, the data signal may be transmitted to the first node N1. The second transistor T2 may be referred to as a scan transistor.

The storage capacitor Cst may be connected between the first node N1 corresponding to a gate electrode of the first transistor T1 and a second electrode of the first transistor T1. The storage capacitor Cst may store a voltage corresponding to the voltage difference between the gate electrode and the second electrode of the first transistor T1.

A first electrode (anode electrode or cathode electrode) of the light emitting diode LD may be connected to the second electrode of the first transistor T1, and a second electrode (cathode electrode or anode electrode) of the light emitting diode LD may be connected to the second power source line VSSL. The light emitting diode LD may generate light with a predetermined luminance in response to the amount of current (driving current) supplied from the first transistor T1.

The light emitting diode LD may be an organic light emitting diode. The light emitting diode LD may be an inorganic light emitting diode such as a micro light emitting diode or a quantum dot light emitting diode. The light emitting diode LD may include organic and inorganic materials. In FIG. 2, it the pixel PXij includes a single light emitting diode LD. The pixel PXij may include a plurality of light emitting diodes, and the light emitting diodes may be connected in series, parallel, or series-parallel.

The voltage of the first power source may be supplied to the first power source line VDDL, and the voltage of the second power source may be applied to the second power source line VSSL. The voltage of the first power source may be greater than the voltage of the second power source.

If the scan signal of a turn-on level (e.g., logical high level) is applied through the scan line SLi, the second transistor T2 is turned on. At this time, a voltage corresponding to the data signal applied to the data line DLj may be stored in the first node N1 (first electrode of storage capacitor Cst).

A driving current corresponding to a voltage difference between the first electrode and a second electrode of the storage capacitor Cst may flow between the first electrode and the second electrode of the first transistor T1. Accordingly, the light emitting diode LD may emit light with a luminance level corresponding to the data signal.

The global current value GC provided by the current sensor 500 of FIG. 1 may be a value obtained by summing driving current values flowing through all pixels PX of the display panel 100. Since the magnitude of the data signals is adjusted by scaling the gradation values corresponding to the scale factor SF generated by the scale factor provider 700 of FIG. 1, the driving current values of the pixels PX may be adjusted.

The structures of pixel PXij of FIG. 2 may be applied to other pixels of the display panel 100. The pixel PXij may further include a transistor which electrically connects the second electrode of the first transistor T1 and a first electrode of the light emitting diode LD and/or a first electrode of the first transistor T1 and the first power source line VDDL when being turned on by an emission control signal. The pixel PXij may further include a sensing transistor that senses the voltage or current applied to the second electrode of the first transistor T1 or the first electrode of the light emitting diode LD and transmits the sensed current to the sensing line when being turned on by a sensing signal supplied through a separate sensing line.

Figure 3:
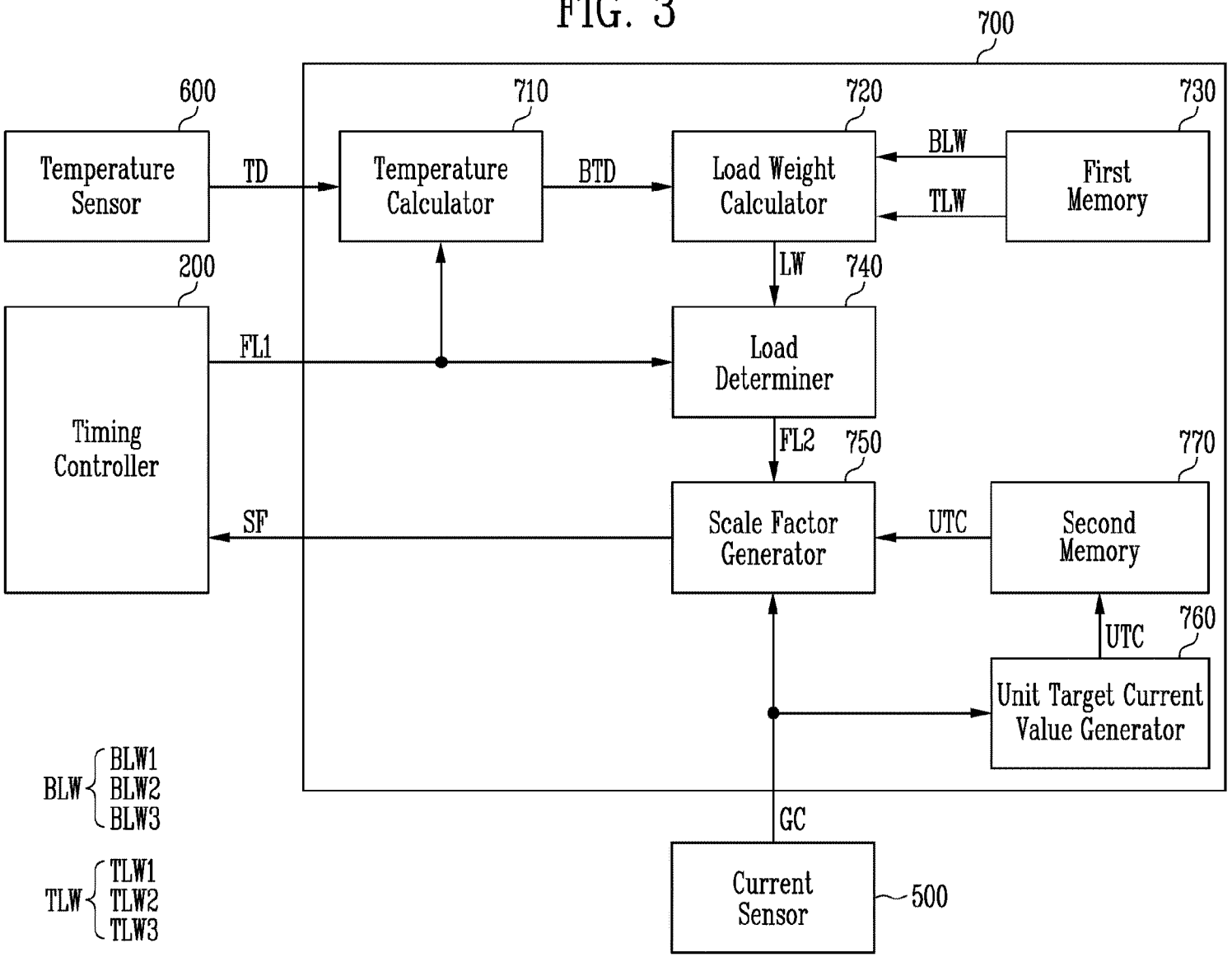
FIG. 3 is a block diagram for explaining a scale factor provider according to embodiments.
Figure 4:
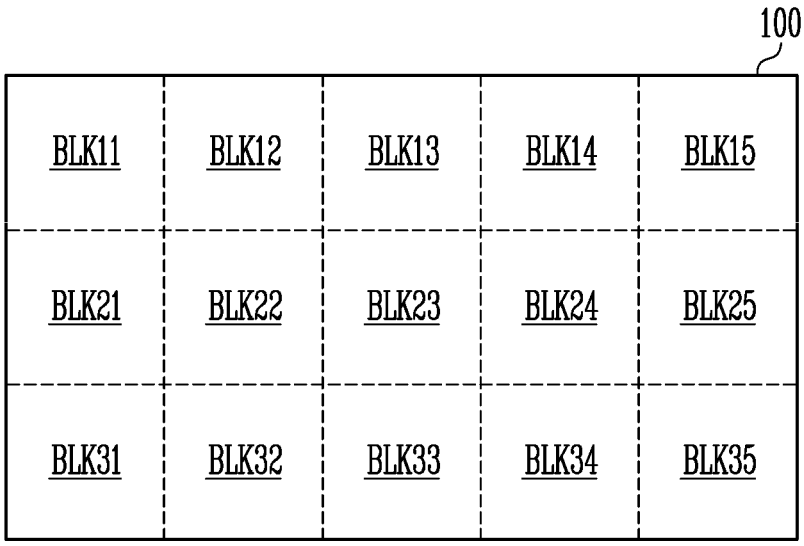
FIG. 4 is a diagram illustrating a display panel included in the display device of FIG. 1 according to embodiments.
Figure 5:
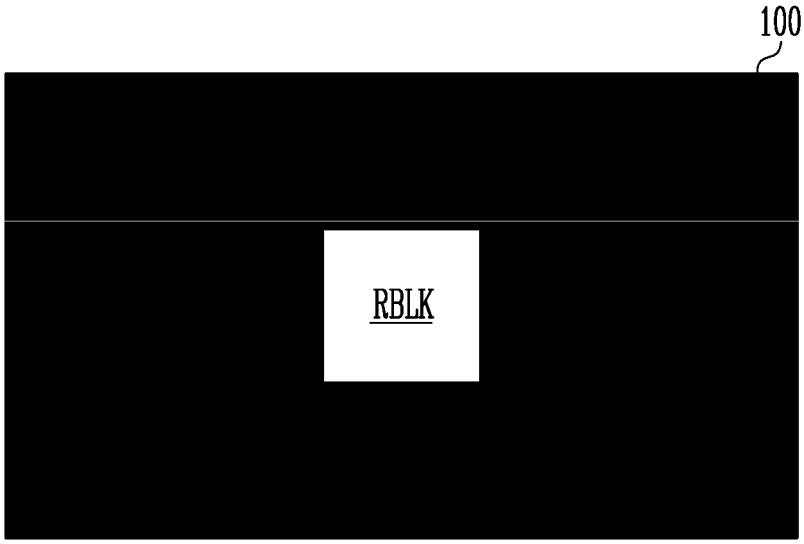
FIG. 5 is a diagram illustrating a reference block set on the display panel of FIG. 4 according to embodiments.
Figure 6:
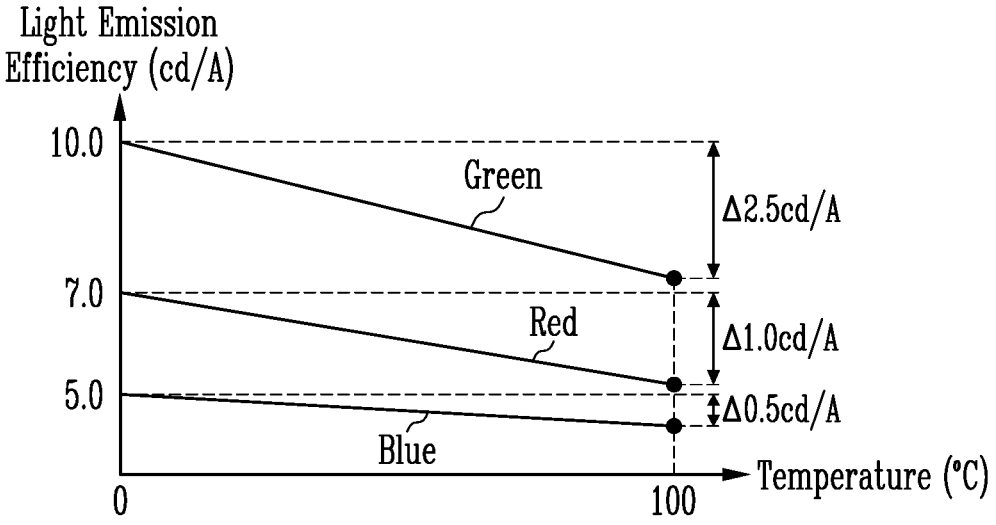
FIG. 6 is a graph for explaining the light emission efficiency of a pixel according to the (ambient) temperature according to embodiments.
Figure 7A:
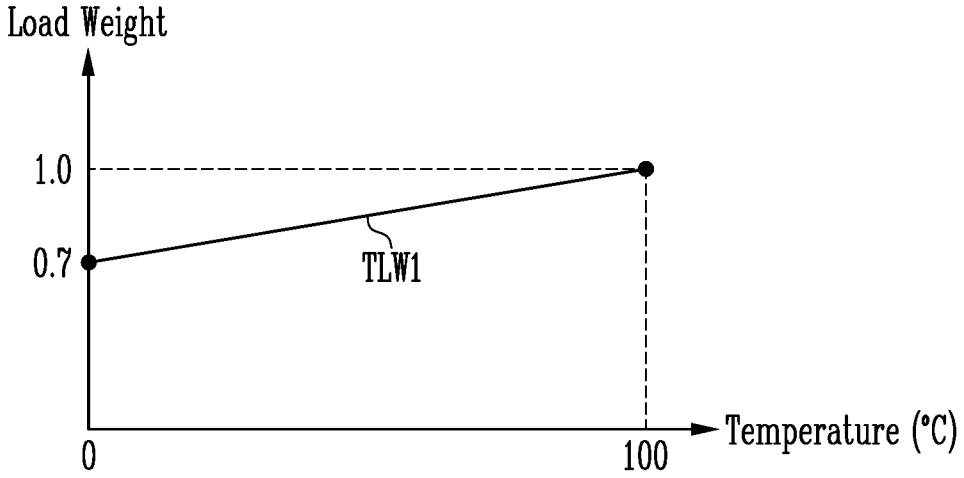
FIG. 7C is a graph for explaining a load weight applied for a pixel according to the (ambient) temperature according to embodiments.
Figure 7B:
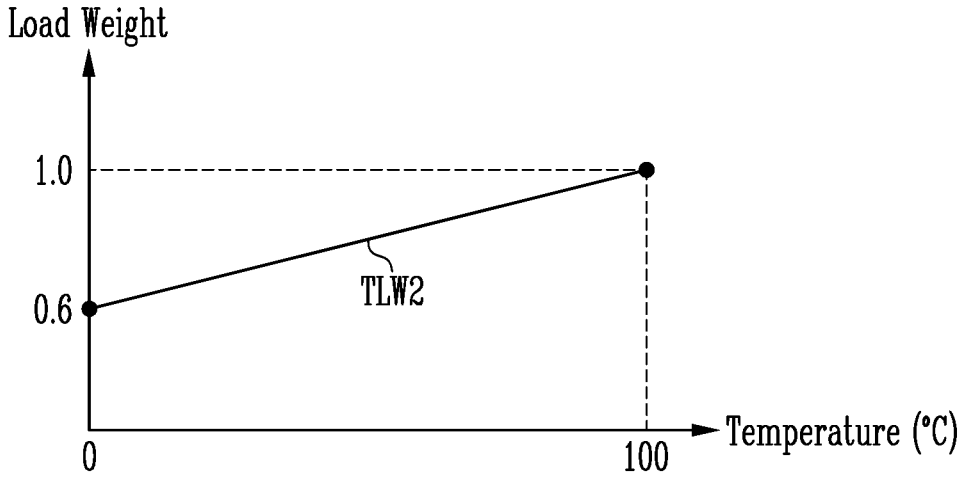
Figure 7C:
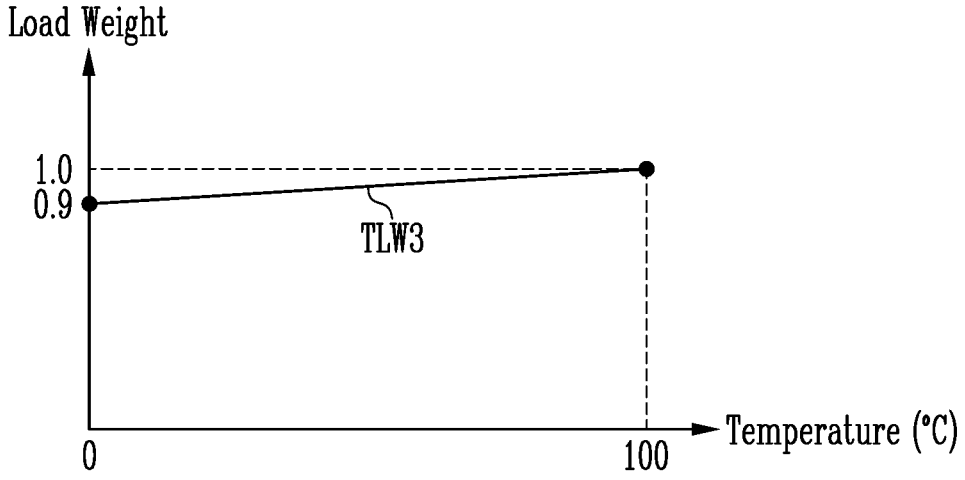

FIG. 3 is a block diagram for explaining the scale factor provider according to embodiments. FIG. 4 is a diagram illustrating the display panel included in the display device of FIG. 1 according to embodiments. FIG. 5 is a diagram for explaining the reference pixel group in the display panel of FIG. 4 according to embodiments. FIG. 6 is a graph for explaining light emission efficiency levels of a pixel according to temperature values according to embodiments. Each of FIG. 7A, FIG. 7B, and FIG. 7C is a graph for explaining load weight values applied for a pixel according to temperature values.

The display device 1000 (and/or scale factor provider 700) may set at least one among the pixel groups as the reference pixel group in order to perform a unit target current value (UTC) storage operation.

Referring to FIG. 4, the pixels PX of the display panel 100 may be divided into a plurality of pixel groups BLK11, BLK12, BLK13, BLK14, BLK15, BLK21, BLK22, BLK23, BLK24, BLK25, BLK31, BLK32, BLK33, BLK34, and BLK35. Each of the pixel groups BLK11 to BLK35 may include at least one pixel. The total number of pixel groups BLK11 to BLK35 may be equal to or smaller than the total number of pixels of the display panel 100.

By dividing the display panel 100 into pixel groups BLK11 to BLK35 having the same size, the pixel groups BLK11 to BLK35 may include the same number of pixels. In embodiments, all or some of the pixel groups BLK11 to BLK35 may share one or more pixels, and/or some of the pixel groups BLK11 to BLK35 may include more pixels than other pixel groups.

FIG. 4 illustrates that the display panel 100 is divided into 15 pixel groups BLK11 to BLK35. The display panel 100 may be divided into fewer or more pixel groups, such as 100 pixel groups.

Referring back to FIG. 3, FIG. 4, and FIG. 5, when the display device 1000 is turned on, the display device 1000 may emit light from the reference pixel group RBLK among the pixel groups BLK11 to BLK35. The reference pixel group RBLK may correspond to the pixel group BLK23 located at the center of the display panel 100. The reference pixel group RBLK may be set at other positions. For example, the reference pixel group may be a pixel group located outside the display panel 100. As another example, two or more of the pixel groups BLK11 to BLK35 may be set as the reference pixel group.

The pixels included in the reference pixel group RBLK may emit light at the highest gradation level (for example, the white gradation level), and the remaining pixel groups may not emit light (for example, remaining at the black gradation level).

At this time, the current sensor 500 may generate the global current value GC by sensing a current flowing through the first power source line VDDL, and may provide the global current value GC to a unit target current value generator 760 of the scale factor provider 700.

The unit target current value generator 760 may generate a unit target current value UTC corresponding to the global current value GC. For example, the unit target current value generator 760 may store the global current value GC as the unit target current value UTC on a second memory 770. As illustrated in FIG. 4 and FIG. 5, one of the 15 pixel groups BLK11 to BLK35 (for example, the pixel group BLK23) is set as the reference pixel group RBLK. When the display device 1000 is turned on, the pixels included in the reference pixel group RBLK may emit light with the highest gradation, and the remaining pixel groups do not emit light. Therefore, the global current value GC may be equal to the unit target current value UTC multiplied or divided by approximately 6.67%, or 1/15, based on the full-white image frame. When the display panel 100 is divided into 100 pixel groups, one of the 100 pixel groups which is set as the reference pixel group may emit light with the highest gradation, and the remaining pixel groups do not emit light. Therefore, the global current value GC may be equal to the unit target current value UTC multiplied or divided by 1%, or 1/100 based on the full-white image frame.

In an embodiment, the unit target current value UTC may be generated when the display device 1000 is turned on, may be stored on/in a second memory 770 of the scale factor provider 700, and may be used during a display period of image frames of the display device 1000 afterwards.

The scale factor provider 700 may generate the scale factor SF in consideration of variations of the light emission efficiency levels of the pixels PX for pixel groups and variations of the light emission efficiency levels of the pixels PX according to the ambient temperature.

The scale factor provider 700 may include a temperature calculator 710, a load weight calculator 720, a first memory 730, a load determiner 740, a scale factor generator 750, the unit target current value generator 760, and the second memory 770. The unit target current value generator 760 may generate the unit target current value UTC corresponding to the global current value GC, and the second memory 770 may store the unit target current value UTC.

The temperature calculator 710 may receive the temperature data TD from the temperature sensor 600, and may receive the frame load value FL1 from the timing controller 200. The timing controller 200 may calculate a frame load value FL1 for each of the pixel groups BLK11 to BLK35.

The temperature calculator 710 may calculate predicted temperature data BTD for each of the pixel groups BLK11 to BLK35 based on the temperature data TD and the frame load value FL1 calculated for the corresponding pixel group of the pixel groups BLK11 to BLK35. Temperatures of the pixel groups BLK11 to BLK35 of the display panel 100 may be different according to the frame load values FL1. For example, the temperature of a pixel group having a high frame load value FL1 may be higher than the temperature of a pixel group having a low frame load value FL1.

The temperature calculator 710 may include a lookup table in which values of the predicted temperature data BTD corresponding to predetermined frame load values FL1 are stored. Accordingly, the temperature calculator 710 may calculate the predicted temperature data BTD corresponding to the frame load value FL1 for each of the pixel groups BLK11 to BLK35 using the lookup table.

The load weight calculator 720 may calculate a load weight LW using the predicted temperature data BTD from the temperature calculator 710 and using first weight data BLW and second weight data TLW from the first memory 730.

The first weight data BLW may correspond to the light emission efficiency of each of the pixel groups BLK11 to BLK35. The light emission efficiency levels for the pixel groups BLK11 to BLK35 may be different due to process variations. The light emission efficiency levels of the light emitting diodes (for example, light emitting diode emitting red light, light emitting diode emitting green light, light emitting diode emitting blue light, and the like) included in the pixels PX may be different for the pixel groups BLK11 to BLK35. The first weight data BLW may include the weight data BLW1 according to the light emission efficiency for the red gradation, the weight data BLW2 according to the light emission efficiency for the green gradation, and the weight data BLW3 according to the light emission efficiency for the blue gradation corresponding to the pixel groups BLK11 to BLK35. As the light emission efficiency for the same supply current is high, the pixels PX may emit light with high luminance. Accordingly, for each of the pixel groups BLK11 to BLK35, as the light emission efficiency of each of the red gradation, the green gradation, and the blue gradation is high, the weight data BLW1, the weight data BLW2, and the weight data BLW3 may be small. The first weight data BLW corresponding to the pixel group having the minimum light emission efficiency for each of the red gradation, the green gradation, and the blue gradation may have a value of 1. The first weight data BLW corresponding to the remaining pixel groups may have a value corresponding to the respective light emission efficiency levels with reference to the light emission efficiency of the pixel group having the minimum light emission efficiency. As an example, when the pixel group having the minimum light emission efficiency has 6 cd/A for the red gradation, the weight data BLW1 corresponding to the pixel group having the minimum light emission efficiency may have a value of 1, and the weight data BLW1 corresponding to the pixel group having 6.6 cd/A may have a value of approximately 0.91, or 6/6.6.

A test current corresponding to the input image data IDATA of each of the red gradation, the green gradation, and the blue gradation is applied to each of the pre-shipment pixel groups BLK11 to BLK35 of the display panel 100. At this time, the light emission efficiency of the red gradation, the green gradation, and the blue gradation corresponding to each of the pixel groups BLK11 to BLK35 may be measured based on the measured light emission luminance. The first weight data BLW may be stored on the first memory 730 in a form of a lookup table.

The second weight data TLW may correspond to the light emission efficiency of a pixel according to the ambient temperature. The light emission efficiency for a first pixel including a first light emitting diode emitting the red light, the light emission efficiency for a second pixel including a second light emitting diode emitting the green light, and the light emission efficiency for a third pixel including a third light emitting diode emitting the blue light may be different according to the ambient temperature. The second weight data TLW may be stored on the first memory 730 in the form of a lookup table.

Referring to FIG. 6, the light emission efficiency levels (unit: cd/A) for light emitting diodes according to the ambient temperature (temperature unit, □C) are illustrated. The light emission efficiency levels corresponding to the first light emitting diode emitting the red light, the second light emitting diode emitting the green light, and the third light emitting diode emitting the blue light are illustrated.

As illustrated in FIG. 6, at 0° C., the light emission efficiency corresponding to the second light emitting diode is 10 cd/A, the light emission efficiency corresponding to the first light emitting diode is 7 cd/A, and the light emission efficiency corresponding to the third light emitting diode is 5 cd/A. As the temperature increases, the light emission efficiency corresponding to each light emitting diode may decrease. For example, at 100° C., the light emission efficiency corresponding to the second light emitting diode is 7.5 cd/A, the light emission efficiency corresponding to the first light emitting diode is 6 cd/A, and the light emission efficiency corresponding to the third light emitting diode is 4.5 cd/A. Since materials included in light emitting diodes are different, the degrees of decrease in the light emission efficiency according to the increment of the temperature may be different for the light emitting diodes.

The second weight data TLW may include the weight data TLW1 corresponding to the first light emitting diode, the weight data TLW2 corresponding to the second light emitting diode, and the weight data TLW3 corresponding to the third light emitting diode. Weight change rates according to temperature of the second weight data TLW may be different for different light emitting diodes.

Referring to FIG. 7A, FIG. 7B, and FIG. 7C, at 100° C., all the weight data TLW1, the weight data TLW2, and the weight data TLW3 may have a value of 1; at 0° C., the weight data TLW1 may have a value of 0.7, the weight data TLW2 may have a value of 0.6, and the weight data TLW3 may have a value of 0.9. At a temperature (for example, 100° C.) corresponding to the minimum light emission efficiency for each of the light emitting diodes, the second weight data TLW may have the value of 1; below the temperature of the minimum light emission efficiency, the second weight data TLW may be determined by applying different weight change rates for different light emitting diodes.

The load weight calculator 720 may calculate the load weight LW corresponding to each of the pixel groups BLK11 to BLK35 based on the predicted temperature data BTD, the first weight data BLW, and the second weight data TLW.

The load weight calculator 720 may calculate the weight for each of the red gradation, the green gradation, and the blue gradation of a pixel group by multiplying the corresponding one of the weight data TLW1, the weight data TLW2, and the weight data TLW3 according to the temperature of the pixel group based on the predicted temperature data BTD for one pixel group among the pixel groups BLK11 to BLK35 and the corresponding one of the weight data BLW1, the weight data BLW2, and the weight data BLW3 of the pixel group, and may calculate the load weight values LW of the pixel group by multiplying the weights for the red gradation, the green gradation, and the blue gradation. The load weight calculator 720 may calculate the load weight LW corresponding to each of the pixel groups BLK11 to BLK35 by applying light emission efficiency variations for the pixel groups BLK11 to BLK35 and variations of the light emission efficiency for the light emitting diodes according to the ambient temperature.

Referring to FIG. 3, the load determiner 740 may receive the frame load value FL1 for each of the pixel groups BLK11 to BLK35 from the timing controller 200, and may receive the load weight LW for each of the pixel groups BLK11 to BLK35 from the load weight calculator 720.

The load determiner 740 may calculate a correction load value FL2 based on the frame load value FL1 and the load weight LW. For example, the load determiner 740 may calculate the correction load value FL2 by multiplying the frame load value FL1 and the load weight LW for each of the pixel groups BLK11 to BLK35, and adding all the multiplied values.

The scale factor generator 750 may determine the target current value based on the unit target current value UTC and the correction load value FL2 received from the unit target current value UTC and the load determiner 740. For example, the scale factor generator 750 may determine the target current value by multiplying the unit target current value UTC and the correction load value FL2. The scale factor generator 750 may generate the scale factor SF by comparing the target current value with the global current value GC received from the current sensor 500. For example, the scale factor generator 750 may determine a ratio between the target current value and the global current value GC as the scale factor SF.

The display device 1000 (and/or scale factor provider 700) may perform the global current control operation in consideration of light emission efficiency variations for the pixel groups BLK11 to BLK35 and light emission efficiency variations of the pixels PX according to the ambient temperature. Accordingly, an appropriate current may be supplied to the pixels PX. Advantageously, the display device 1000 may display images with satisfactory quality.

The embodiments described above are illustrative. Practical embodiments can be implemented with various combinations, changes, environments, and/or modifications within the scope defined by the appended claims.

What is claimed is:

1. A display device comprising:

a pixel set that includes pixels, the pixels being divided into pixel groups;

a timing controller that is electrically connected to the pixel set, calculates first load values corresponding to an image frame of input image data, and generates image data by scaling gradation values of the input image data using scale factors;

a data driver that is electrically connected to at least one of the pixel set and the timing controller, generates data signals corresponding to the image data, and supplies the data signals to the pixel set; and a scale factor provider that calculates one or more second load values based on the first load values and temperature data corresponding to a temperature of the pixel set, and generates the scale factors based on the one or more second load values and a common current value corresponding to a common current flowing through the pixels.

2. The display device of claim 1, wherein the scale factor provider includes a unit target current value generator that generates a unit target current value based on a common current value corresponding to a reference pixel group among the pixel groups.

3. The display device of claim 2, wherein the scale factor provider further includes a scale factor generator that generates a target current value based on the unit target current value and the one or more second load values, and generates the scale factors based on the target current value and the common current value corresponding to the common current flowing through the pixels.

4. The display device of claim 1, wherein the timing controller calculates a first load value corresponding to each of the pixel groups.

5. The display device of claim 4, wherein the scale factor provider further includes a temperature calculator that calculates predicted temperature data sets for the pixel groups based on the temperature data and the first load values.

6. The display device of claim 5, wherein the scale factor provider further includes a load weight calculator that calculates load weights based on the predicted temperature data sets, first weight data sets, and second weight data sets.

7. The display device of claim 6, wherein each of the first weight data sets corresponds to light emission efficiency values of a corresponding one of the pixel groups, and each of the second weight data sets corresponds to light emission efficiency of the pixels in an associated one of the pixel groups according to the temperature of the pixel set.

8. The display device of claim 7, wherein the load weight calculator calculates a load weight by multiplying a value from a corresponding second weight data set and a value from a corresponding first weight data set, and the value from the corresponding second weight data set is according to the temperature of the pixel set based on a corresponding predicted temperature data set.

9. The display device of claim 7, wherein the pixel groups include a first pixel group and a second pixel group, light emission efficiency for the first pixel group is higher than light emission efficiency for the second pixel group, and a value of the first weight data set for the first pixel group is smaller than a value of the first weight data set for the second pixel group.

10. The display device of claim 7, wherein a first temperature of the pixel set is lower than a second temperature of the pixel set, and a value of the second weight data set for the first temperature of the pixel set is larger than a value of the second weight data set for the second temperature of the pixel set.

11. The display device of claim 10, wherein the pixels include a first pixel including a first light emitting diode, a second pixel including a second light emitting diode, and a third pixel including a third light emitting diode, the load weight calculator calculates a second weight data set for the first light emitting diode, a second weight data set for the second light emitting diode, and a second weight data set for the third light emitting diode, and the second weight data set for the first light emitting diode, the second weight data set for the second light emitting diode, and the second weight data set for the third light emitting diode are unequal according to the temperature of the pixel set.

12. The display device of claim 6, wherein the load weight calculator calculates the load weights respectively corresponding to the pixel groups.

13. The display device of claim 12, wherein the scale factor provider further includes a load determiner that calculates the one or more second load values based on the first load values and the load weights respectively corresponding to the pixel groups.

14. The display device of claim 13, wherein the load determiner calculates the one or more second load values by multiplying a corresponding first load value and a corresponding load weight for each of the pixel groups to produce multiplied values and by adding the multiplied values.

15. The display device of claim 1, wherein the pixels include a current sensor that is connected to a first power source line and generates the common current value by sensing a current transmitted through the first power source line.

16. The display device of claim 1, further comprising:

a temperature sensor that generates the temperature data by sensing the temperature of the pixel set.

17. A method of operating a display device, the display device including a pixel set, the pixel set including pixels, the pixels being divided into pixel groups, the method comprising:

calculating one or more first load values corresponding to an image frame of input image data;

calculating one or more second load values based on the one or more first load values and temperature data corresponding to a temperature of the pixel set;

generating one or more scale factors based on the one or more second load values and a common current value corresponding to a common current flowing through the pixels;

generating image data by scaling gradation values of the input image data using the one or more scale factors;

generating data signals corresponding to the image data; and supplying the data signals to the pixels for the pixels to emit light according to the data signals.

18. The method of claim 17, wherein the generating of the scale factor comprises:

generating a unit target current value based on a common current value corresponding to a reference pixel group among the pixel groups;

generating a target current value based on the unit target current value and the one or more second load values; and generating the one or more scale factors based on the target current value and the common current value corresponding to the common current flowing through the pixels.

19. The method of claim 17, wherein the calculating of the one or more second load values comprises:

calculating predicted temperature data sets for the pixel groups based on the temperature data and the one or more first load values;

calculating load weights based on the predicted temperature data sets, first weight data sets, and second weight data sets; and calculating the one or more second load values based on the one or more first load value and the load weights.

20. The method of claim 19, wherein each of the first weight data sets corresponds to light emission efficiency values of a corresponding one of the pixel groups, and each of the second weight data sets corresponds to light emission efficiency of the pixels in an associated one of the pixel groups according to the temperature of the pixel set.

* * * * *